US007867153B2

(12) United States Patent
Roman et al.

(10) Patent No.: US 7,867,153 B2
(45) Date of Patent: Jan. 11, 2011

(54) GYMNASTIC MACHINE

(75) Inventors: Maurizio Roman, Noale (IT); Leo Zaccherini, Riolo Terme (IT)

(73) Assignee: Technogym S.p.A., Gambettola (FC) (IT)

( * ) Notice: Subject to any disclaimer, the term of this patent is extended or adjusted under 35 U.S.C. 154(b) by 623 days.

(21) Appl. No.: 11/705,154

(22) Filed: Feb. 9, 2007

(65) Prior Publication Data

US 2007/0225136 A1 Sep. 27, 2007

(30) Foreign Application Priority Data

Feb. 10, 2006 (IT) ..... RA2006A0009

(51) Int. Cl.
*A63B 21/00* (2006.01)

(52) U.S. Cl. ..... 482/137; 482/133

(58) Field of Classification Search ..... 482/72, 482/95, 96, 129, 133, 135–138, 140
See application file for complete search history.

(56) References Cited

U.S. PATENT DOCUMENTS 4,928,957 A * 5/1990 Lanier et al. ..... 482/73
5,169,363 A * 12/1992 Campanaro et al. ..... 482/96
5,334,120 A * 8/1994 Rasmussen ..... 482/97
5,354,251 A * 10/1994 Sleamaker ..... 482/96
5,743,832 A * 4/1998 Sands et al. ..... 482/52
5,810,698 A * 9/1998 Hullett et al. ..... 482/96
6,244,995 B1 * 6/2001 Prsala ..... 482/96
6,926,647 B1 * 8/2005 Huang et al. ..... 482/72
7,004,890 B2 * 2/2006 Webb et al. ..... 482/100
7,455,633 B2 * 11/2008 Brown et al. ..... 482/142
2002/0132706 A1 * 9/2002 Sleamaker ..... 482/51
2004/0009855 A1 * 1/2004 Webber ..... 482/94

* cited by examiner

*Primary Examiner*—Loan Thanh
*Assistant Examiner*—Allana Lewin
(74) *Attorney, Agent, or Firm*—Abelman, Frayne & Schwab

(57) ABSTRACT

A gymnastic machine (1) includes a first frame (10), a first support member (22) carried by the first frame (10) by means of a guiding device (20) to be movable along at least one given direction (D), the first support member (22) being shaped to be interfaced with a first body region of a user and a bearing member (30) being rotatably supported by the first frame (10) around an axis (32) transverse to the given direction (D), the bearing member (30) being shaped to be interfaced to a second body region.

29 Claims, 7 Drawing Sheets

Fig. 1
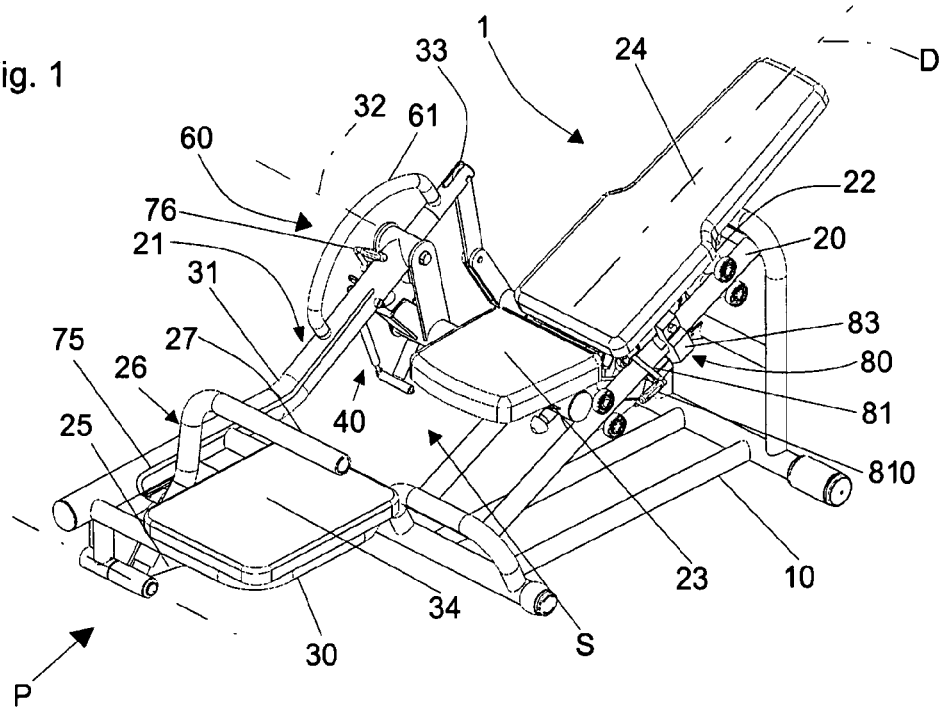
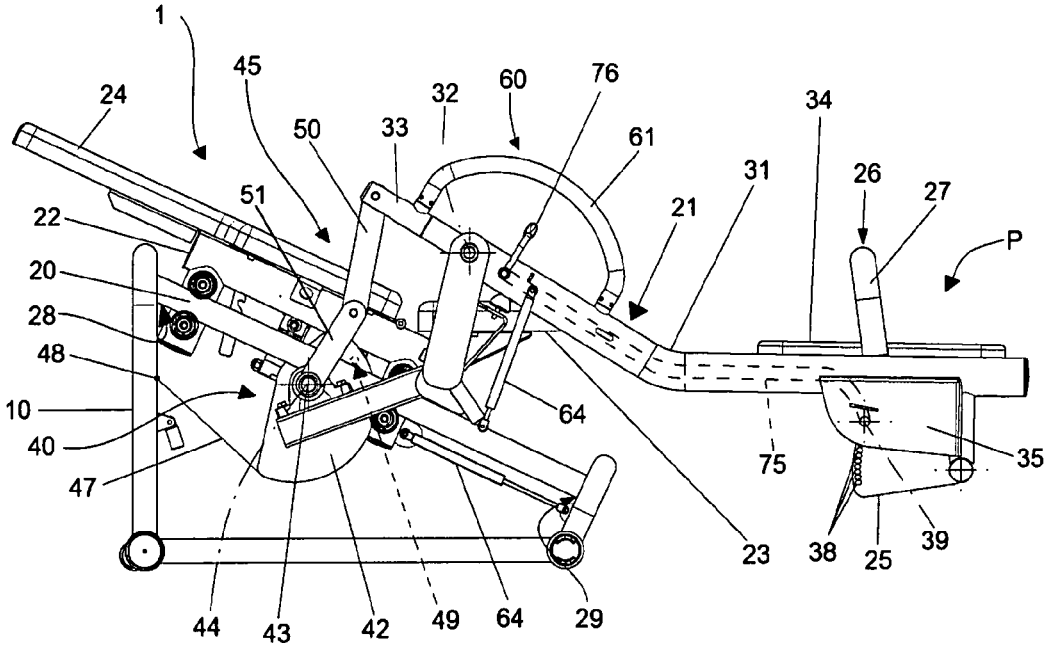
Fig. 2

Fig. 3
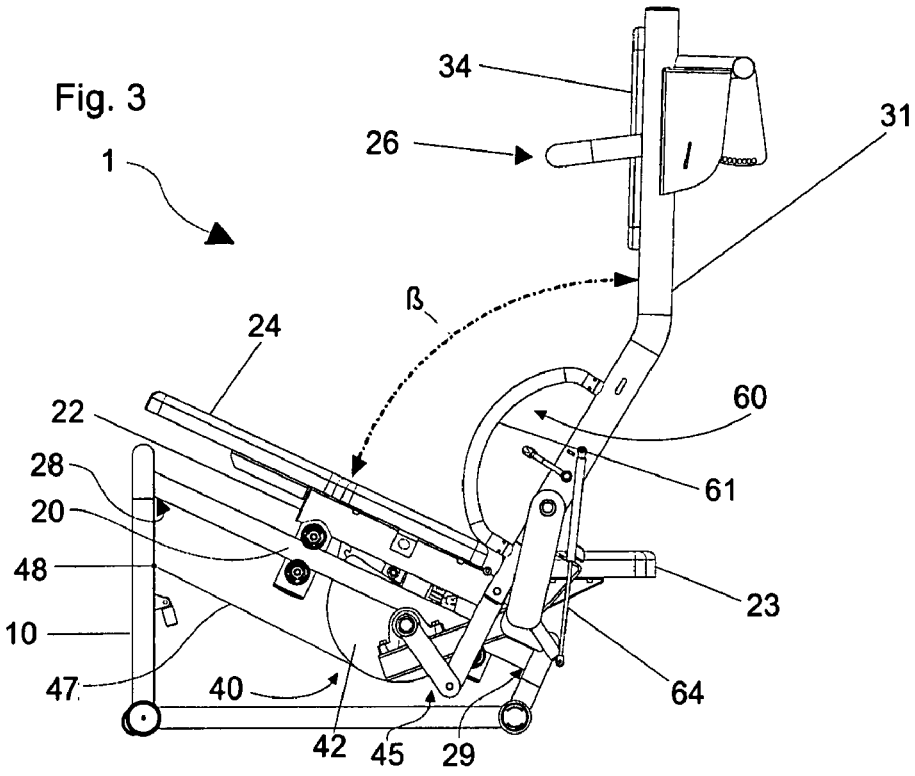
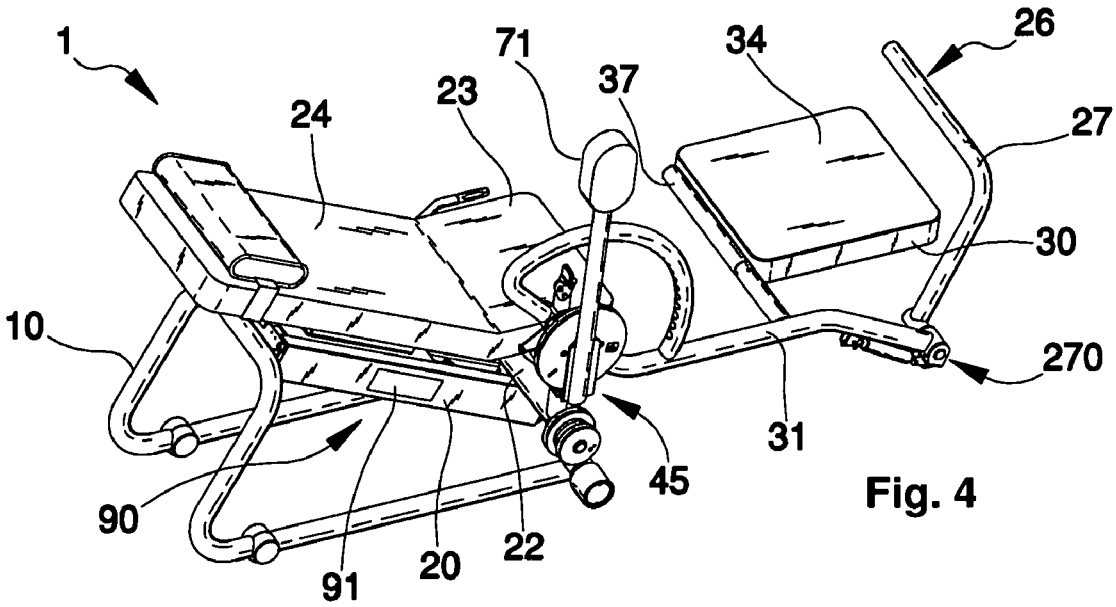
Fig. 4

Fig.10
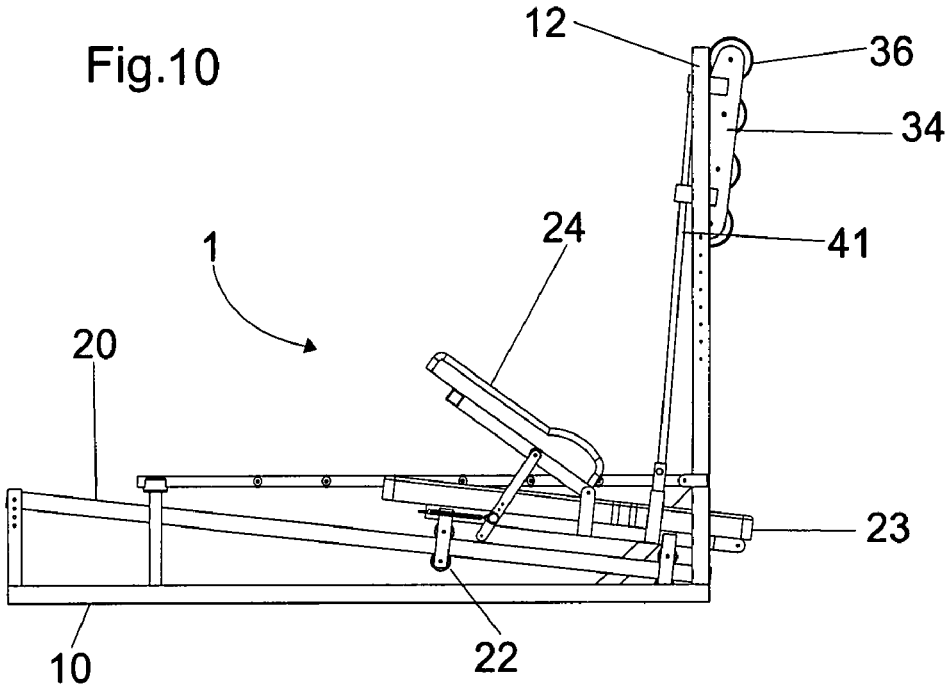
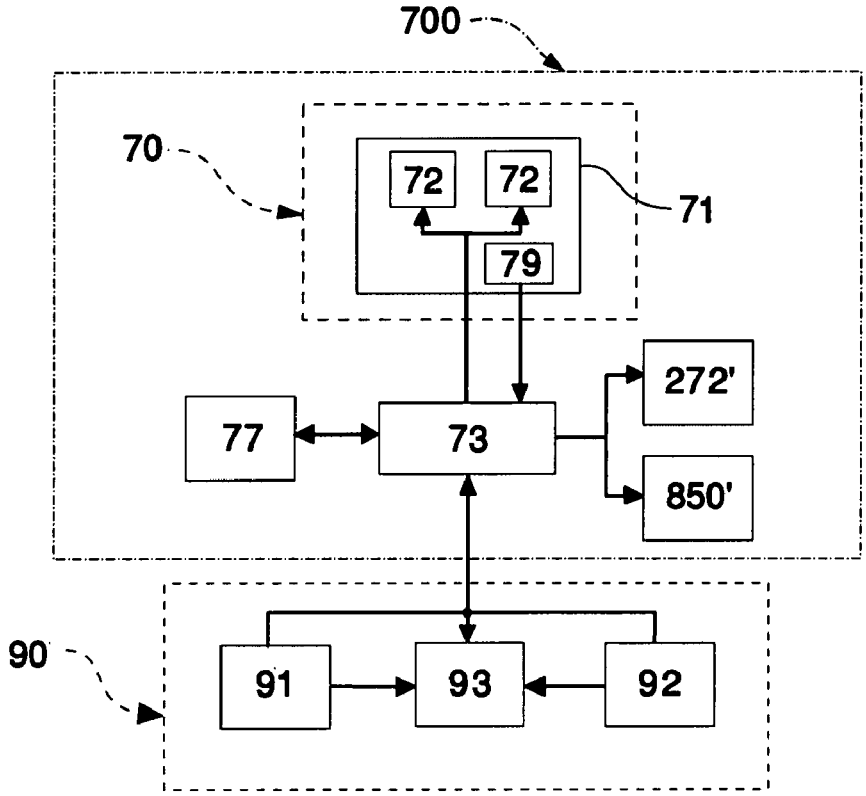
Fig. 13

GYMNASTIC MACHINE

BACKGROUND OF THE INVENTION

1. Field of the Invention

The present invention relates to a gymnastic machine, in particular, the present invention relates to a gymnastic machine provided with a support that is validly usable to perform muscle stretching exercises. The present invention also relates to a method for using a gymnastic machine for muscle stretching.

2. Description of the Prior Art

It is well known that in the field of gymnastic machines for muscular activities of various kinds, the machines dedicated to muscle stretching are a narrow minority. This fact is mainly justified by the critical nature of stretching exercises which are only apparently simple, but in fact are particularly insidious if executed by an inexperienced athlete without a supervising trainer, given the high quantity of degrees of freedom left to the athlete while executing such exercises. Therefore, the market for said machines is very limited, because the presence of a trainer could place every athlete, even if inexperienced, in the condition of executing effective stretching exercises also free style, or through the simple availability of a wall or of a tree, if outdoors, or of a wall bar, if in a gym.

One can take, for instance, the gymnastic machine that embodies the teachings of Italian Patent No. 1,286,435, which is normally used in gyms in training classes, in such a way as to group athletes sharing the need to be assisted during the execution of muscle stretching exercises. It is thereby possible to economize the number of trainers and hence the training costs. On the other hand, the need to stretch muscles is particularly pressing, and it would be desirable to have available a machine for muscle stretching that can be used at one's own residence in total safety without the assistance of a trainer every time the need is felt, e.g. to prevent lumbar pains, which by their nature have strongly invalidating characteristics. Said exercises for stretching muscles in the lumbar region are recommended not only for athletes, but also for persons who are out of condition.

In view of the above description, the problem of having available a gymnastic machine for stretching muscles of the type described above is currently unsolved, and it represents an interesting challenge for the applicant, for the purpose of facilitating the prevention of lumbar pains without having to consume pain-relief drugs, which anyway cannot be considered definitive remedies.

In consideration of the situation described above, it would be desirable to have available a gymnastic machine for muscle stretching that, in addition to allowing to limit and possibly overcome the typical drawbacks of the prior art, illustrated above, could define a new standard for such types of gymnastic machines also for home installations.

SUMMARY OF THE INVENTION

An object of the present invention is to provide a gymnastic machine that allows the disadvantages described above to be solved, and which is suitable to satisfy a plurality of requirements that to date have still not been addressed, and therefore, suitable to represent a new and original source of economic interest and capable of modifying the current market of gymnastic machines for muscle stretching.

Another object of the present invention is to provide a method of using the gymnastic machine for muscle stretching.

These and other objects of the present invention, which will become apparent hereinafter, are achieved by providing a gymnastic machine including a first frame, a first support member carried by said first frame through a guiding device to be movable along at least one given direction, with the first support member being shaped to be interfaced with a first body region of a user, and characterised by further including a first bearing member supported rotatable by the first frame around a first transverse axis transverse to the given direction to assume, in use, an inclination as a function of the first support member relative to the first frame; and by providing a method for training on a gymnastic machine for muscle stretching and including the steps of engaging a second support member carried movable by a second frame, engaging a third bearing member carried rotatable relative to the second frame with one's legs, rotating one's legs around a fourth axis, and characterised in that to the step of rotating one's legs around the fourth axis is correlated the step of varying the position of the second support member along a given path.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

Further characteristics and advantages of the gymnastic machine and of the method according to the present invention will be more apparent from the description below, set forth with reference to the accompanying drawings, which illustrate some non-limiting examples of embodiment, in which identical or corresponding parts of the machine are identified by the same reference numbers. The drawings show:

FIG. 1 is a schematic perspective view of a first preferred embodiment of a gymnastic machine according to the present invention in a first operative position and with some parts removed for the sake of clarity;

FIG. 2 is a lateral elevation view of FIG. 1;

FIG. 3 is a lateral elevation view of FIG. 1 in a second operative position with some parts removed for the sake of clarity;

FIG. 4 is a schematic perspective view with some parts removed for the sake of clarity of a second preferred embodiment of FIG. 1;

FIG. 10 is a lateral elevation view of a fifth preferred embodiment of FIG. 1 shown in a sixth operative position;

FIG. 13 shows a schematic block diagram of a control device associated to a gymnastic machine according to FIG. 4 or 5.

DETAILED DESCRIPTION OF THE PREFERRED EMBODIMENTS

Figure 5:
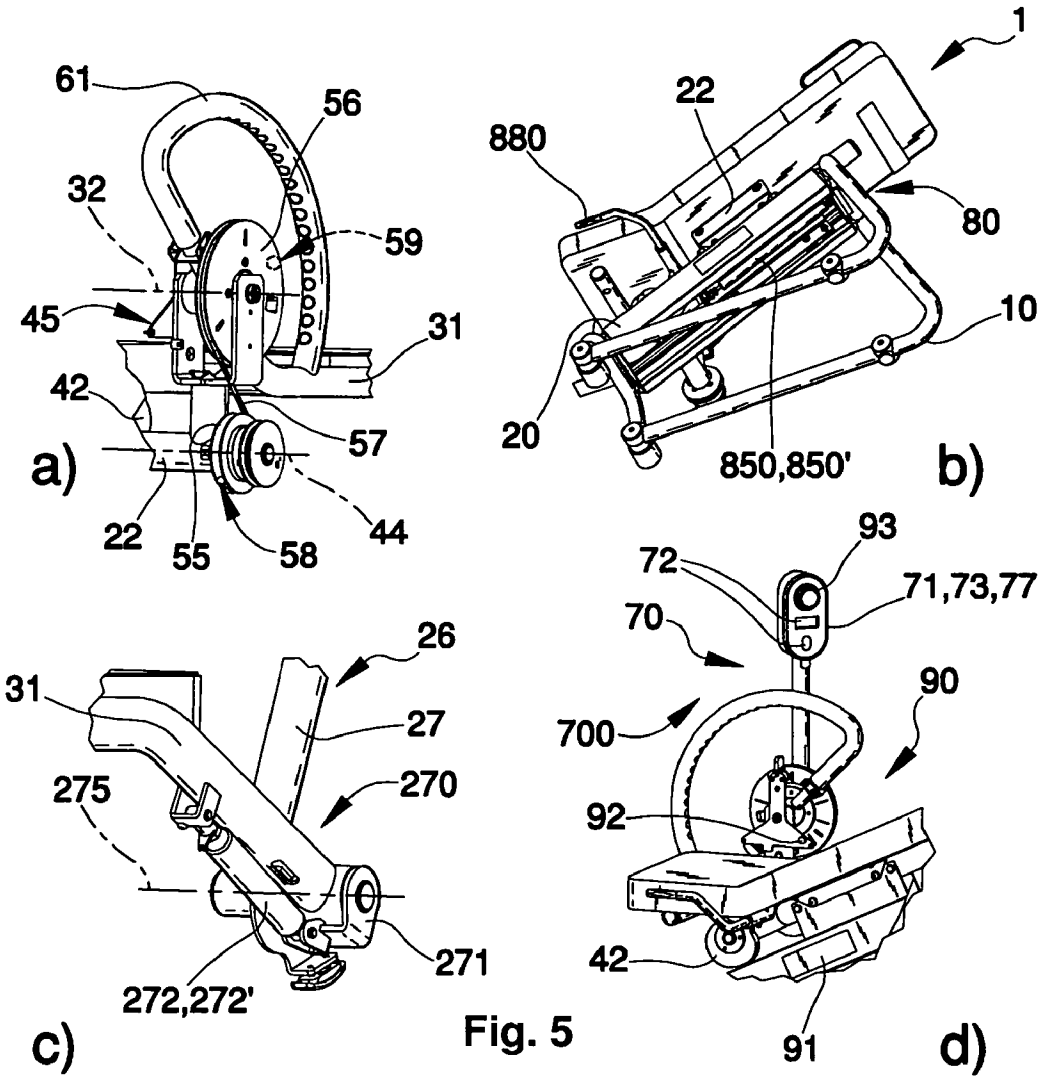
FIG. 5 shows a plurality of details extracted from FIG. 4, represented by means of schematic perspective views.

In FIG. 1, number 1 indicates, in its entirety, a gymnastic machine for muscle stretching. Said machine 1 comprises a frame 10 supporting a support member 22 by means of a guiding device 20 so constructed as to let the support member 22 movable along at least one direction D. The machine 1 further comprises at least one bearing member 30 carried rotatable around an axis 32 transverse to the given direction D. Both the support member 22 and the bearing member 30 are so shaped as to be interfaced respectively to a first and to a second body region of a user.

In particular, it should be noted that, in view of the above description, the guiding device 20 may preferably, but without limitation, comprise a pair of cylindrical guides 20 able to constrain the support member 22 to be movable along a given direction D defined by the guides 20. With particular reference to FIG. 1, each guide can be validly embodied by a cylindrical tube; therefore hereinafter the term guide 20 may indicate, globally or individually, the two cylindrical tubes.

In addition, with reference to the FIGS. 1-3, it should be noted that the direction D is inclined in such a way that the slide 22 is able to be actuated by gravity along each respective guide 20; furthermore, the bearing member 30 can be inclined, in use, around the axis 32 relative to the given direction D according to an inclination angle that is a function of the position of the slide 22 on the guide 20 itself, as it will be more readily apparent hereafter.

In particular, but without limiting the scope of protection of the present invention, with reference to FIG. 1, the slide 22 comprises a seat 23 and a backrest 24 rigidly connected to each other, and the bearing member 30 comprises a cradle 34 supported by a shelf 31 connected to the slide 22 to support the legs of a user around the axis 32. It should be noted that the latter is positioned relative to the seat 23 and to the backrest 24 to be substantially coaxial to a transverse axis of rotation of a user's thighs relative to his/her pelvis. Therefore, each user in training, who is in supine position with the glutei bearing on the seat 23, the back supported by the backrest 24 and the legs supported by the cradle 34, will have the back and the thighs mutually inclined by a given angle of inclination, which depends on an angle β between the backrest 24 and the cradle 34 shown in FIG. 3 only. It should be noted that, hereinafter, the letter β shall be used to designate exclusively the convex angle, i.e. an angle less than 180°, defined by the backrest 24 and by the cradle 34, and that said angle β of inclination will always be modulated by the position occupied instantaneously by the slide 22 on the guide 20. The consequence will be a stretching action exercised in different proportions for each user at least at a respective rear muscle region, between the back and the legs, and in any case including the lumbar region. It should be noted that for displacements of the slide 22 between a first end stop 28 of the guide 20 positioned on the upper part in FIG. 2 and a second end stop 29 of the guide 20 positioned on the lower part in FIG. 2, the angle between the back and the thighs of a training user decreases, and vice versa.

Naturally, the above description made with reference to a rectilinear guide 20 also applies for a guide comprising cylindrical bodies curved in a given fashion in a median vertical plane for the machine 1. In this case, a curved guide 20 would introduce an additional element for modulating the trajectory of the slide 22, which is added to the current position of the slide 22 on the guide 20, element that could influence the manner in which the angle β varies during the execution of an exercise.

With particular reference to FIG. 2, the machine 1 comprises a regulating device 40 for setting the relative inclination between the shelf 31/the cradle 34 and the backrest 24. Said regulating device 40 comprises an actuating member 42 carried rotatable by the slide 22 by means of a shaft 43 coaxial to an additional axis 44 transverse to the direction D and positioned at opposite side from the backrest with respect to the guide 20, hence located below the guide 20 in FIG. 1. Furthermore, the regulating device 40 comprises a transmission device 45 coupled to the actuating member 42 to determine a rotation of the shelf 31 around the axis 32. Said regulating device 40 further comprises a retaining member 47 associated to the actuating member 42 to determine its rotation as the position of the slide 22 of the backrest 24 along the guide 20 varies. In particular, still with reference to FIG. 2, said retaining member 47 finds simple embodiment by means of a cable 47 partially wound on the periphery of the actuating member 42 and provided with a first end 48 connected rigidly to the frame 10 at the opposite side from the axis 32. On the other hand, the same cable 47 presents a second end 49 rigidly connected to the actuating member 42 to apply to said member 42 a torque able to cause the rotation of the shelf 31 around the axis 32. It should be noted that the actuating member 42 comprises a cam 42 so shaped as to modulate the torque to minimise the energy required to set in rotation the shelf 31 starting from an initial position P of the shelf 31 in which the training user is positioned with the respective legs extended and substantially horizontal (FIGS. 1 and 2). Therefore, the cam 42 is able to determine the rotation of the shelf 31 under the action of gravity as the position of the slide 22 along the direction D changes.

With reference to the FIGS. 1-3, and in particular with reference to FIG. 2, it will be noted that the transmission device 45 comprises at least one lever 50 hinged to the shelf 31 at a portion 33 of the shelf 31 that extends from the opposite side of the cradle 34 relative to the axis 32. Said lever 50 is hinged through the respective ends to a lever 51 rigidly connected to the shaft 43 in such a way that to each rotation of the cam 42 around the axis 44 corresponds an opposite rotation of the shelf 31 around the axis 32. Therefore, in view of the above description, the set of the lever 50 and of the lever 51 can be interpreted as a compass mechanism, whilst the transmission device 45 can also be interpreted as a device 45 for inverting the rotation, able to rotate said actuating member 42 in opposite direction to said shelf 31 and vice versa.

The machine 1 can also comprise a control device 60 for regulating the rotation of the cradle 34. In particular with reference to FIGS. 1-3, and with particular reference to FIG. 2, said device 60 for controlling the rotation of the cradle 34 acts directly on the shelf 31 controlling its rotation. In this regard, said device 60 comprises a handle 61 that is rigidly connected to the shelf 31 and presents substantially circular shape and substantially constant cross section. The handle 61 presents a curvature with wide radius, in such a way as to make it particularly easy and not particularly tiresome to control the rotation of the shelf 31, and in view of the above description to determine a feedback on the position of the seat 23 and of the backrest 24 on the guide 20. In fact, control on the handle 61 can be exercised combining in various ways the gripping pressure of the handle 61 and the peripheral thrust thereon, in such a way as to contrast or facilitate the rotation of the shelf 31. The control device 60 further comprises at least one speed limiting member 64. In particular, said member 64 can be positioned between one of the members carried rigidly by the slide 22 and the shelf 31, or between the slide 22 and the frame 10, since the movement of the shelf 31 is a function of the movement of the slide 22 on the respective guide 20. In the first case, the member 64 can comprise a shock absorber 64 positioned between the slide 22 and the shelf 31 at the side of the cradle 34 relative to the axis 32. In the second case, the member 64 can comprise a shock absorber 64 connected directly to the slide 22 and to the frame 10 for example oriented parallel to the given direction D. It should be noted that, merely for the sake of convenience of representation, only one shock absorber 64 has been shown, positioned between the slide 22 and the second end stop 29 and only in FIG. 2.

With reference to any one of the FIGS. 1-3, it should be noted that a contrast device 26 is associated to the cradle 34, device that, in use, can be employed as a bearing for the tips of a user's feet to induce the stretching of the rear muscles of the legs. In any case, even if action on the rear muscles of the legs to obtain their stretching was not desired, the contrast device 26 enables to avoid the plantar flexion of the user's feet to optimise exercises for stretching the lumbar and thigh muscles. It is well known, in fact, that moving the tip of the feet away from the knee during the reduction of the angle β would reduce the effectiveness of the traction stress on the rear muscle region of the hips and of the thighs and, therefore, their stretching.

With particular reference to FIG. 1 and to FIG. 2, the device 26 comprises a substantially L shaped tubular body 27 that is carried by the bearing member 30/by the shelf 31 in a freely rotatable manner around an axis 275 of rotation that is substantially transverse to the given direction D. Said body 27 carries a circular sector 25 that is provided with a plurality of radial holes 38 transverse to the direction D, better described hereafter. The device 26 further comprises a plate 35 rigidly fastened to the bearing member 30 in a position facing the circular sector 25 and provided with a pivot pin 39 carried movable transversely by the plate 35 itself to engage selectively each of the holes 38 in such a way as to fasten, in use, the circular sector 25/the tubular body 27 in a given angular position relative to the shelf 31. It will be noted that it is possible to use a device 21 for switching the position of the pivot pin 39 actuated by means of a Bouden cable 75, positioned between the cradle 34 and a portion of the shelf 31 adjacent to the first axis 32 through a lever 76, which may be carried by the shelf 31 itself as in FIG. 2.

It should be noted that the cradle 34 is supported laterally in a cantilevered fashion by the shelf 31, in such a way as to give rise to a free space S between the seat 23/the backrest 24 and the cradle 34, providing ease of access to the machine 1, and hence to the backrest 24.

Use of the machine 1 described above is readily understandable from the description provided, and requires no further explanation. It should nonetheless be kept in mind that the axis 32 is integral with the slide 22, and therefore always remains substantially coaxial with the rotation axis of the thighs relative to the pelvis for any angle assumed by the shelf 31 relative to the direction D, regardless of the position assumed by the slide 22 on the guide 20. Furthermore, it should be noted that the speed limiting member 64 brakes the slide 22 in its descending motion, and that the user can modulate the rotation of the respective legs through the aforesaid actions exercisable through the handle 61.

Figure 11:
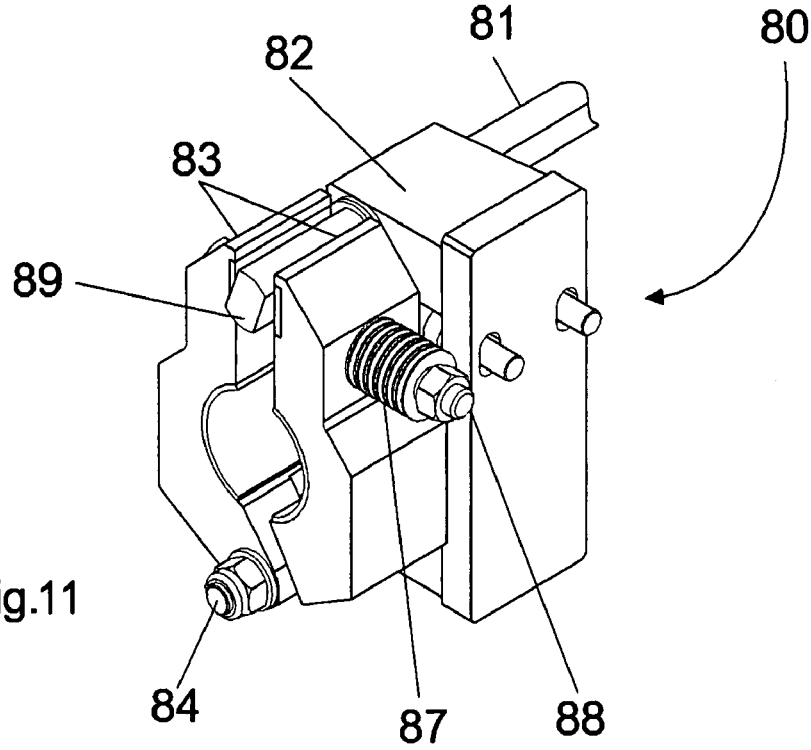
FIG. 11 is a schematic perspective view in enlarged scale and with some parts removed for the sake of clarity of a detail extracted from FIG. 1.
Figure 12:
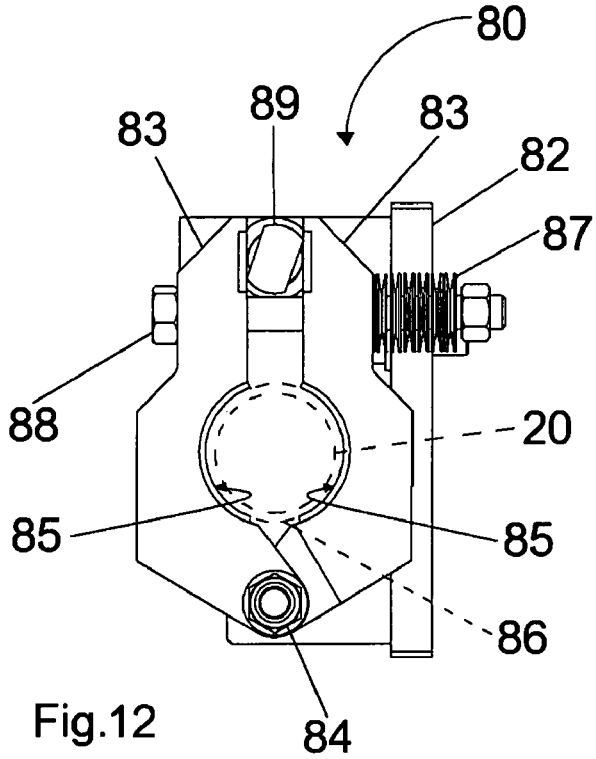
FIG. 12 is a schematic perspective view in enlarged scale and with some parts removed for the sake of clarity of a detail extracted from FIG. 1.

Always with reference to FIG. 1, it will be noted that the regulating device 40 comprises a device 80 for blocking the slide 22 relative to the frame 10, in such a way as to fasten indirectly also the angular position of the shelf 31 relative to the frame 10. In particular, the blocking device 80 is conceived to interact with at least one of the guides 20, which is represented with dashed line in FIG. 12 only. With reference to FIGS. 11 and 12, the device 80 comprises a member 82 that is connected to the slide 22 in preferably, but not limiting, releasable fashion, and it supports a pair of jaws 83 hinged to each other through a respective pivot pin 84 parallel to the respective guide 20 to face each other. Again with reference to FIGS. 11 and 12, the two jaws 83 comprise respective concavities 85 which present a substantially semi-cylindrical shape to define a substantially cylindrical housing 86 that houses the respective guide 20 in selectively matching fashion. In particular, the two jaws 83 can be switched from and to a position of engagement by friction of the respective guide 20, in which the concavities 85 are thrust against each other by a torsion spring 87 carried by a pin 88 transverse to the axis of the respective guide 20. In the embodiment of FIGS. 11 and 12, the pin 88 comprises a screw provided with a head associated to one of the two jaws 83, and with a stem that is axially coupled by the spring 87. Said spring 87 is held axially by a nut coupled to the stem of the screw. Again with reference to FIGS. 11 and 12, the two jaws 83 can be switched from the blocking position of the slide 22 relative to the respective guides 20 by a lever 81 which, as shown in FIGS. 1 and 11, is carried in a freely rotatable manner by the member 82 and presents a respective actuation head 89, housed between the jaws 83 in eccentric position relative to the centre of the respective concavities 85 to serve as a longitudinal key. With reference to FIG. 11, it will be noted that the head 89 can be actuated in rotation around its longitudinal axis by the lever 81 through a respective handle 810, which is parallel to the guides 20 and is visible, for practical reasons, only in FIG. 1. Therefore, the device 80 is able to maintain the slide 22 rigidly fastened relative to the guiding device 20 in a given position in such a way as to allow to access the machine 1 in conditions of safety, to adjust the contrast device 26 in order to determine the optimal position of the tubular body 27, and, in use, to block the machine 1 with the shelf 31 in any angular position to enable the execution of the muscle stretching exercise with pauses, maximising its ease of execution and effectiveness.

Finally, it is clear that modifications and variants can be made to the gymnastic machine 1 described and illustrated herein without however departing from the protective scope of the present invention.

Naturally, the machine 1 could operate validly even if the direction D was horizontal and any device was provided for the displacement of the slide 22 along the guides 20. Said device, which is not shown in the accompanying tables because of its simple conception, could simply comprise an elongated handle carried longitudinally by the frame 10 to constitute a support which the user could grip to cause the alternating displacement of the slide 22 on the guides 20, causing the alternating variation of the angle β. Naturally, the action exercised by the user could also take place through an actuator able to be operated in any way, e.g. a linear electric motor or a fluid-dynamic actuator, and in any case positioned between the slide 22 and the frame 10.

With reference to FIGS. 4 and 5, a second variant of the machine 1 is shown which, while maintaining the general layout of the version illustrated with reference to FIGS. 1-3, is distinguished from the latter by some particular features. Furthermore, in consideration of what is specified herein, for the sake of convenience, this second variant of the present invention shall be described using, when possible, the reference numbers already used in the description of the machine 1 of FIGS. 1-3. First of all, with particular reference to FIG.

5*a*, the device 45 for transmitting the motion of the slide 22 to the shelf 31 was simplified replacing the mutually hinged levers 50 and 51 with a pair of pulleys, mechanically connected to each other by means of a flexible member. In particular, the device 45 of this second variant of the machine 1 comprises a first pulley 55, carried integrally by the shaft 43 in rotatable manner around the axis 44, and a second pulley 56 carried integrally by the shelf 31 in such a way as to be coaxial to the axis 32. Furthermore, the mechanism 45 comprises a flexible member 57, typically a non-extensible cable 57, which presents its third and fourth ends 58 and 59 integrally connected respectively to the first and to the second pulleys 55 and 56. In particular, the flexible member 57 is wound peripherally around the pulleys 55 and 56 in such a way as to enable a mutual exchange of a torque between said pulleys. In more detail, with particular reference to FIG. 5*a*, the flexible member 57 is partially wound in counter-clockwise direction around the first pulley 55 and in clockwise direction around the second pulley 56 in order to associate to each rotation of the first pulley 55 an opposite rotation of the second pulley 56. Moreover, it should be noted that the longitudinal extension of the flexible member 57 is so dimensioned that the flexible member is always tensioned under the action of the force of gravity acting on the shelf 31 to associate univocally to each descending displacement of the slide 22 a counter-clockwise rotation of the shelf 31 in FIG. 4. Therefore, in this case as well, the transmission device 45 can be interpreted as a device 45 for inverting the rotation, able to rotate the first pulley 55 in opposite direction to the second pulley 56 or, more in general, able to rotate said actuating member 42 in opposite direction to said shelf 31 and vice versa.

With particular reference to FIG. 5*b*, the second variant of the machine 1 presents a simplified version of the blocking device 80 in which the jaws 83 have been replaced by at least one hydraulic brake 850 positioned between the slide 22 and the respective frame 10. In particular, each hydraulic brake 850 comprises a gas spring 850 that, as shall be explained better hereafter, is of the selectively releasable type. In this type of gas springs, as is well known, the passage of the fluid between respective chambers known and not illustrated separated by a respective piston known and not shown is regulated by a valve known and not shown which is normally closed and selectively able to be switched by means, for example, of a lever 880 in such a way as to enable and control the transfer of the fluid between the two chambers known and not illustrated and selectively to allow the variation of the longitudinal extension of the gas spring 850 and hence of the angular position of the shelf 31. In particular, and again with reference to FIG. 5*b*, the machine 1 can comprise a single gas brake 850 positioned at the centerline below the slide 22. It should be noted that the lever 880 can be used in substantially identical fashion to the lever 81 of FIG. 1; therefore, acting on said lever 880, a user can selectively release the slide 22 relative to the frame 10 to allow the execution of a muscle stretching exercise. It should also be noted that, in use, the gas spring 850 presents a resistance adjustable with the variation of its longitudinal extension and, therefore, it can be interpreted as a limiting member 850 for adjusting the speed of the slide 22. In view of the above description, it should be noted that, in this second variant of the machine 1, the hydraulic brake 850/the gas spring 850 combines the functions that in the first version of the machine 1 are performed independently by the blocking device 80 and by the speed limiting member 64 in a single device; clearly this specific aspect represents a simplification of the machine 1 and hence it entails a reduction in its production and maintenance costs.

A further simplification of the machine 1 is illustrated with particular reference to FIG. 5*c* which shows a variant of the contrast device 26 provided with a device 270 for regulating the angular position of the tubular body 27 relative to the bearing member 30/cradle 34. In particular the contrast device 26 presents a connecting member 271 positioned opposite to the tubular body 27 and integrally coupled therewith to rotate around the common axis 275 of rotation transverse to the given direction D. Said connecting member 271 may be obtained in a single piece with the tubular body 27 or it may be coupled thereto at the respective fulcrum end or, as shown in FIG. 5*c*, it may be rigidly coupled to a pin carried integrally by the tubular body 27 and coaxial to the axis 275 of rotation. The regulating device 270 further comprises a hydraulic brake 272 that connects the connecting member 271 to the shelf 31 in such a way as to selectively regulate the rotation of the tubular body 27 around the axis 275. In more detail, the hydraulic brake 272 preferably, but without limitation, comprises a gas spring 272 of a selectively releasable type, substantially identical to the one described above with reference to the blocking device 80. In this case, the gas spring 272 can be operated by means of a Bouden cable 75 actuated by a lever 76 in a substantially identical fashion to the one described in the first preferred embodiment of the machine 1. Therefore a user positioned on the seat 23 will be able selectively to unlock the tubular body 27 acting on the lever 76, freely rotate it to an angular position suitable to his/her physical characteristics and lastly lock it again in said position releasing the lever 76.

With particular reference to FIG. 4, the shelf 31 comprises a bearing member 37 for at least one foot of a user; said bearing member 37 may for instance comprise a footrest 37 carried laterally in a cantilevered fashion by the shelf 31 or, as shown in FIG. 4, it may be associated to the cradle 34 at the same side as the slide 22. It should be noted that the presence of the member 37 expands the range of exercises that can be performed using the machine 1, and enables to perform muscle stretching exercises with bent knees able to act on the lumbar muscles and on the glutei without involving the rear muscles of the thighs and/or of the legs.

The machine 1 further comprises a measuring unit 90 able continuously to monitor at least one functional parameter of the machine 1. In particular, and without thereby limiting the scope of the present invention, the unit 90 comprises alternatively, or in combination, a sensor 91 of the position of the slide 22 along the respective guide; a sensor 92 of the inclination of the shelf 31 relative to the slide 22; a time measurer 93, known and not shown, able to measure the duration of a muscle stretching exercise and/or of a training routine. In more detail, the sensor 91 can be obtained, without limitation, by applying to the guide 20 a series of equidistant magnetic notches and equipping the slide 22 with a magnetic field sensor known and not illustrated e.g. a Reed contact. Similarly, the sensor 92 may comprise magnetic notches known and not shown arranged radially on a lateral surface of the actuating member 24 or of the second pulley 56. The magnetic field generated by such notches known and not shown will then measured by a magnetic sensor known and not shown, e.g. a Reed contact, appropriately calibrated to convert said information into an angular amplitude. In addition, the time measurer 93 can be connected electronically to the sensor 91 and/or to the sensor 92 in such a way as to measure, in use, time intervals pertaining to the permanence of the slide 22 and/or of the shelf 31 in a given position, typically the position of execution of a respective stretching exercise.

With particular reference to FIGS. 4 and 5*d*, the machine 1 comprises a signalling device 70 able to provide a user with information about the performance of the gymnastic exercise being executed and/or the training routine. Said device 70 can be coupled rigidly to the frame 10, as shown in FIG. 4, or, alternatively, it can be carried movable by the slide 22; in any case, the device 70 shall be placed in a position that facilitates its reading regardless of the position occupied by a user when using the machine 1. In addition, the device 70 is electronically connected to the unit 90 in such a way that it can display the result of measurements taken by at least one of the sensors associated with said unit. In particular, the device 70 preferably but without limitation comprises a viewer 71 provided with at least a first indicator 72 able, in use, to display information about at least one training parameter. In more detail, the viewer 71 preferably presents at least two numeric indicators which are able to show respectively the instantaneous value of the amplitude of the angle β and at least one duration of the exercise currently being executed; said information can be obtained by a joint use of the time measurer 93 and at least one of the sensors 91 and 92. At this point it is interesting to note that by coupling to the hydraulic brakes 272 and 850 respective actuators 272' and 850' controlled by a programmable control unit 73, it is possible to use a gymnastic machine constructed according to the teachings of the present invention to execute stretching exercises under the sole action of the force of gravity acting on the user positioned on the slide 22 or actively to manage the displacements of the slide 22 and the dual rotations of the shelf 31 in such a way as to allow the execution of stretching exercises also to users who are unable to manage the machine in free and aware fashion, e.g. as a result of traumas or muscular-skeletal pathologies. In particular, the control unit 73 is electronically connected to at least one position sensor associated to the measuring unit 90 in such a way as to receive a feedback pertaining to the operation of each respective actuator 272'/850' and to the consequent displacement of at least one mechanical element of the machine 1. Furthermore, the control unit 73 is electronically connected also to the time measurer 93 in such a way as to allow to measure and regulate the duration of the operation of at least one respective actuator 272'/850' to set a given duration of at least one muscle stretching exercise. Therefore, in view of the above description and purely by way of example, use of at least one actuator 850' provides the machine 1 with the ability to increase, gradually and automatically, the amplitude of the angle β to a pre-set value, or a user may set a predetermined duration for the muscle stretching exercise or for each phase said exercise comprises. For this purpose, the viewer 71 may comprise a data input device 79, e.g. a keyboard or a touchpad, electronically connected to the control unit 73 for the respective programming; therefore, the viewer 71 could be interpreted as a control panel of the machine 1. Said control panel, for simplicity of representation, will be designated with the same number 71. Lastly, the control unit 73 can comprise a memory sub-unit 77 able to store some physical characteristics and/or training data of at least one user, for example, to automate the adjustment of the angular position of the tubular body 27 or the execution of a training routine.

In view of the above description and with particular reference to FIG. 13, the set of the control unit 73, of the memory sub-unit 77, of every actuator 850' and/or 272' and of the control panel/viewer 71 can be interpreted as a control device 700 able to control determinate displacements of at least one of the mechanical components that comprise the gymnastic machine 1 to enable the execution of exercises in manners determinate previously by a user.

With reference to FIGS. 6-7, to FIGS. 8-9 and to FIG. 10, a third, a fourth and a fifth versions of the machine 1 are illustrated, which differ from the machine 1 of FIGS. 1-3 and 4-5 respectively because the bearing member 30/the cradle 34 is connected to the frame 10 instead of to the slide 22. As shall be readily apparent hereafter, said three versions, alternative to those described with reference to FIGS. 1-3 and 4-5 were conceived to limit the number of structural components of the machine 1. In particular, said three alternative versions present many structural components in common with the machines 1 of FIGS. 1-3 and 4-5, and they are substantially equivalent for the effect that can be produced on the rear muscles of a user in training, although they are markedly simpler from the constructive point of view, and easy to use. In consideration of the above, it was decided, for the sake of convenience, to describe the three machines 1 shown in FIGS. 6-10 using, when possible, the reference numbers already used for the part of the description of the previous pages, with reference to the machines 1 of FIGS. 1-3 and 4-5.

In all the versions of the machine 1 illustrated in FIGS. 6-10 the exchange of superficial interactions between the body regions of a training user and the backrest 24/the cradle 34 can be minimised using a plurality of rollers 36, each of which is arranged transversely to the guide 20. In particular, in FIGS. 6-10 said rollers 36 equip only the cradle 34, but it is possible to provide with similar rollers the backrest 24, as well as the seat 23 and the cradle 34 of the machine 1 described with reference to the FIGS. 1-3.

Figure 6:
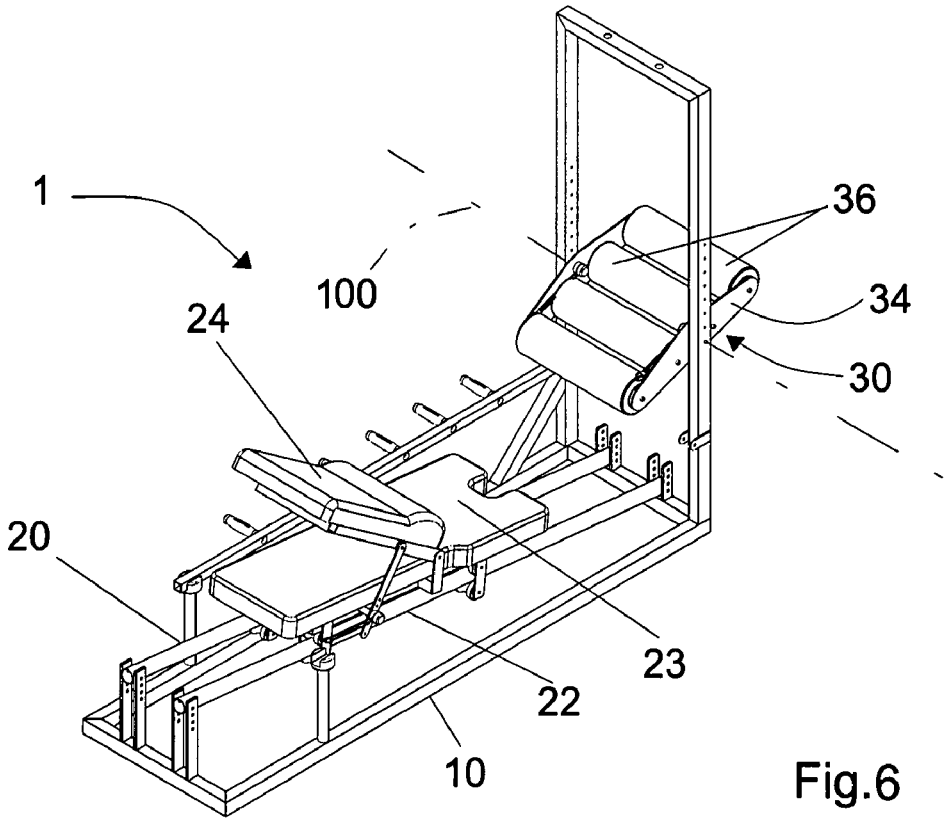
FIG. 6 is a schematic perspective view according to a third observation point of a third preferred embodiment of FIG. 1 in a third operative position.
Figure 7:
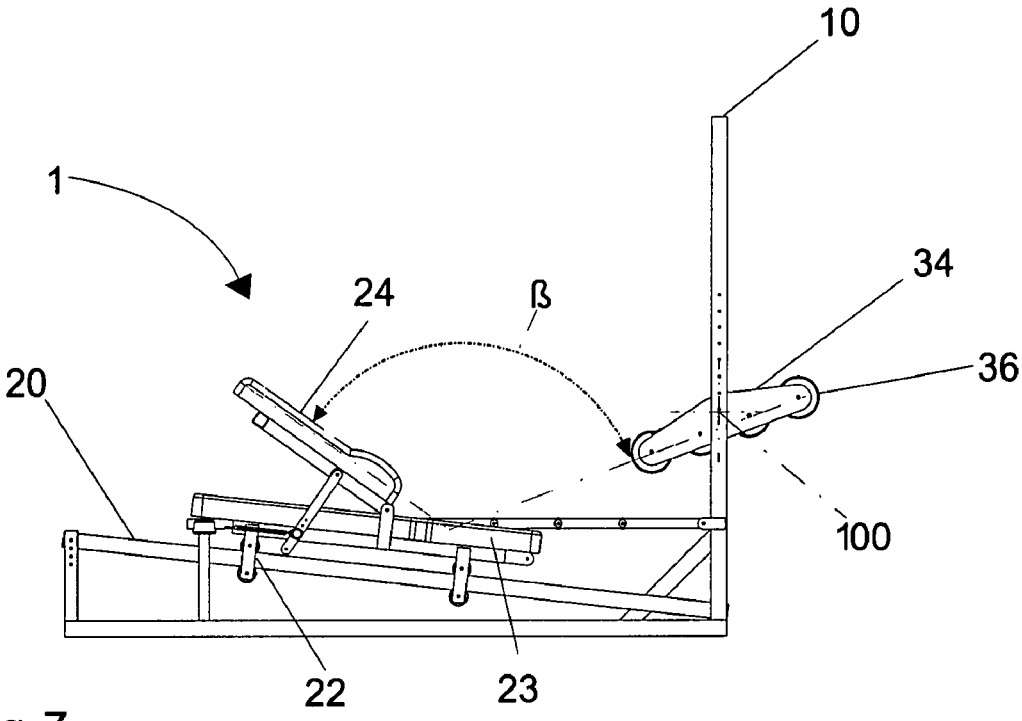
FIG. 7 is a lateral elevation view of FIG. 6.
Figure 8:
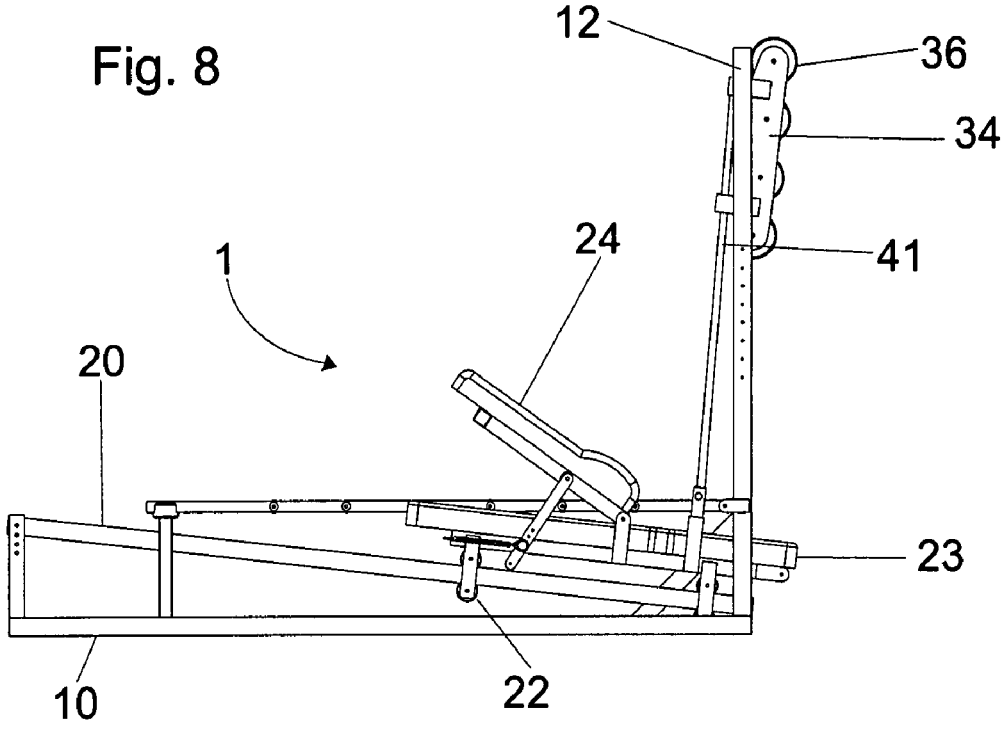
FIG. 8 is a lateral elevation view of a fourth preferred embodiment of FIG. 1 shown in a fourth operative position.
Figure 9:
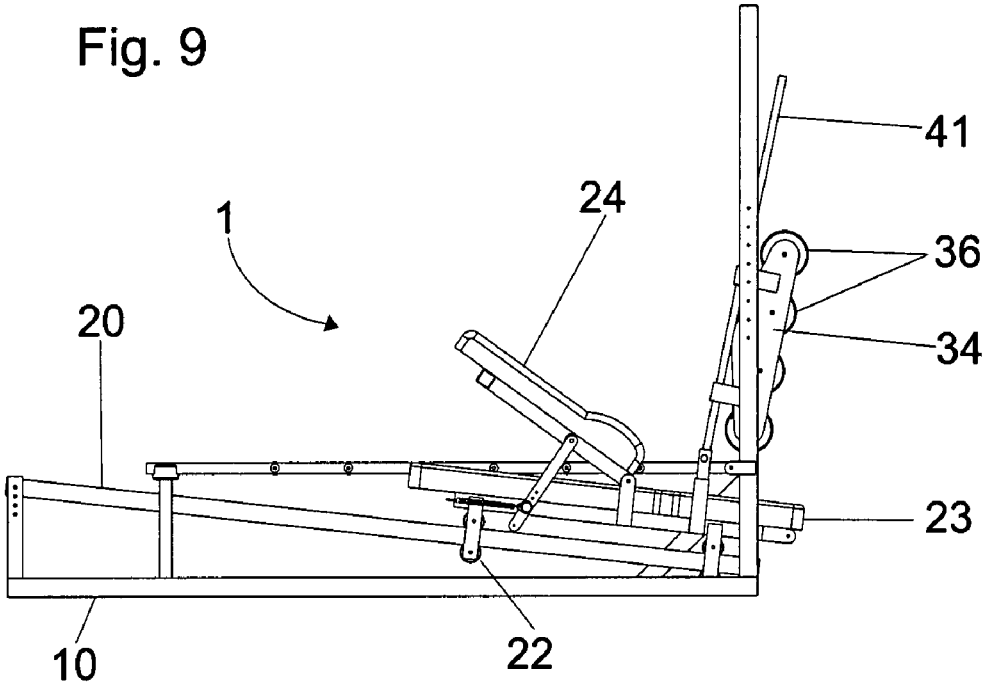
FIG. 9 is a lateral elevation view of FIG. 8 represented in a fifth operative position.

With reference to FIGS. 6 and 7, it is noted that the third version of the machine 1 lacks both the shelf 31, and the regulating device 40 for setting the relative inclination between the shelf 31/the cradle 34 and the backrest 24, whilst with reference to FIGS. 8-10 it is noted that the fourth and the fifth version of the machine 1 lacks only the shelf 31, whilst the regulating device 40 is present. In all three cases, the cradle 34 is supported rotatably relative to the frame 10 at an axis 100 transverse to the direction D. The regulating device 40 of the fourth and of the fifth version of the machine 1 comprises, both with reference to the version of FIGS. 8 and 9, and with reference to the version of FIG. 10, a connecting rod 41 positioned between the cradle 34 and the slide 22 to fasten the cradle 34 to assume, in use, given inclinations according to the position of the slide on the guide 20. In particular, with reference to the version of FIGS. 8 and 9, the rod 41 is connected to the cradle 34 through a freely slidable linear pair, whilst with reference to the version of FIG. 10, the frame 10 presents a guide 12 inclined in determinate fashion relative to the guide 20 and the rod 41 is rigidly connected to the cradle 34, which, in turn, is connected to the guide 12 in freely slidable fashion at the transverse axis 100. This axis 100 is clearly movable along the guide 12 in the version of FIG. 10, whilst it is fixed in the case of FIGS. 8 and 9.

Note that in the case of the third version, shown in FIGS. 6-7, the angle β is a function of the position of the slide 22 on the guide 20 through the interposition of the lower limbs of a user, which determine the inclination of the cradle 34 relative to the frame 10 as a function of the position of the slide 22 on the guide 20.

In view of the above description with reference to the FIGS. 1-12 it is easy to understand that each machine 1 described above can be validly used to implement a training method that comprises, in succession, the step of assuming a supine position with one's back bearing against the backrest 24, the glutei on the seat 23, the legs on the cradle 34; the step of substantially aligning the axis of rotation of a user's femurs in a manner that is substantially transverse to the given direction D; the step of rotating a user's femurs around his/her pelvis, to which is associated the step of changing the position of the backrest 24 on the guide 20 along the given direction D.

Naturally, said step may be carried out exploiting the force of gravity that acts on the training user if the direction D is inclined as in FIGS. 1-10, or other types of actions that enable to move the slide 22 on the respective guides 20. On the other hand, note that with reference to the machine 1 shown in FIGS. 1-3 or 4-5, the axis of rotation of a user's femurs around his/her pelvis is substantially coaxial to the first axis 32.

Naturally, by so doing, through each machine 1 illustrated in the accompanying drawings, the step of rotating the femurs around an axis that is substantially transverse to the given direction D comprises/is associated to the step of reducing and alternatively increasing the amplitude of the angle between the user's thighs and his/her torso as the distance of the backrest 24/of the seat 23 from the lower end stop 29 of the guide 20 decreases/increases.

In view of the above description, the machine 1 described with reference to the accompanying drawings punctually solves the technical problems set out above and its use is easy and safe even for users who are inexperienced in muscle stretching, and in fact it is useful in the prevention of muscle pains in the lumbar region.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A gymnastic machine, comprising a frame;

a support member comprising a slide carried in a freely slidable manner along a given direction by said frame through a guiding device comprising at least one guide extending longitudinally in said given direction; and a first bearing member rotatably supported by said support member around a first axis transverse to said given direction to assume, in use, a respective inclination as a function of a position of said support member relative to said frame;

said slide comprising a backrest and a seat shaped to be interfaced, in use, with body region of a user, and said first bearing member comprising a cradle carried by a shelf rotatably supported by said slide at said first transverse axis and able to support user's legs;

regulating means being provided for setting the relative inclination between said cradle and said backrest as a function of the position of said support member relative to said frame in such a way that to each position of said slide on said at least one guide corresponds to a given inclination angle between said backrest and said cradle, to determine a given stretching action on at least one rear muscle region of the user;

wherein said regulating means comprises an actuating member rotatably carried around a second axis transverse to said given direction, and a transmission unit mutually coupled in such a way that, in use, said actuating member is able to determine a rotation of said shelf around said first transverse axis through said transmission unit.

2. A machine according to claim 1, wherein said guiding device is shaped to constrain said support member to be movable along said given direction by gravity.

3. A machine according to claim 1, wherein said given direction is rectilinear.

4. A machine according to claim 1, wherein said given direction is curved.

5. A machine according to claim 1, wherein said given direction is inclined.

6. A machine according to claim 1, wherein said transmission unit comprises a device for rotating said actuating member in a direction that is opposite to a direction of rotation of said shelf.

7. A machine according to claim 6, wherein said actuating member is rotatably carried by said slide by means of a shaft movable with said backrest relative to said frame along said given direction under the action of gravity; a retaining member being associated with said actuating member to determine rotation of the actuating member as the position of said slide along said guide relative to said frame varies.

8. A machine according to claim 7, wherein said retaining member comprises a cable partially wound on a periphery of said actuating member and having a first end thereof rigidly connected to said frame and a second end thereof rigidly connected with said actuating member to apply thereto a torque capable to determine the rotation of said shelf through said transmission unit.

9. A machine according to claim 6, wherein said actuating member comprises a cam shaped to modulate said torque in such a way as to facilitate the rotation of said shelf starting from a respective reference position in which respective legs of a user extend substantially horizontal.

10. A machine according to claim 6, wherein said transmission unit comprises at least one compass mechanism having a first lever hinged to said shelf and a second lever hinged to said first lever and coupled integrally to said shaft.

11. A machine according to claim 6, comprising a control device suitable, in use, to act directly on said shelf for regulating the rotation of said cradle.

12. A machine according to claim 11, wherein said control device comprises a handle carried rigidly by said shelf.

13. A machine according to claim 12, wherein said handle presents substantially circular shape.

14. A machine according to claim 12, wherein said control device comprises limiting means for regulating the speed of displacement of said slide along said guide.

15. A machine according to claim 14, wherein said limiting means comprises at least one shock absorber that connects said slide to said frame.

16. A machine according to claim 15, wherein said limiting means comprises at least one shock absorber positioned between said slide and said shelf.

17. A machine according to claim 1, wherein said regulating means comprises a blocking device to maintain said slide rigidly fixed relative to said frame in a given position in such a way as to facilitate access to said seat and make possible, in use, execution of muscle stretching exercises with pauses.

18. A machine according to claim 17, wherein said blocking device comprises a pair of jaws facing each other and switchable from and to a position of engagement by friction of at least one of said guides through a longitudinal key against a spring biasing force.

19. A machine according to claim 18, wherein said longitudinal key is rotatably carried between said jaws, and said key can be actuated by a third lever.

20. A machine according to claim 18, wherein said jaws are mutually hinged to each other.

21. A machine according to claim 17, wherein said blocking device comprises at least a hydraulic brake positioned between said slide and said frame.

22. A machine according to claim 1, wherein a contrast device is provided, in combination with said first bearing member, to induce, in use, a stretching action of a user's leg muscles.

23. A machine according to claim 1, wherein said contrast device comprises a substantially L-shaped tubular body, carried by said shelf transversely to said given direction and capable to serve as contrast for soles of a user's feet to induce a stretching of the rear muscles of the user's legs.

24. A machine according to claim 23, wherein said contrast device comprises a substantially L-shaped tubular body, carried by said shelf transversely to said given direction and capable to serve as contrast for soles of a user's feet to induce a stretching of the rear muscles of the user's legs.

25. A machine according to claim 23, wherein said tubular body is carried by said shelf in a freely rotatable manner transversely to said given direction and comprises a circular sector provided with a plurality of radial holes; a plate being carried rigidly by said shelf in a position facing the circular sector and provided with a transverse abutment member capable to be selectively aligned with each of the holes to fasten, in use, the circular sector/the tubular body in a predetermined angular position relative to the shelf.

26. A machine according to claim 25, wherein said contrast device comprises a switching device for adjusting a position of the transverse abutment member actuated through a Bouden cable.

27. A machine according to claim 26, wherein said shelf supports at least a second bearing member for user's feet to enable execution of muscle stretching exercises with bent knees.

28. A machine according to claim 27, wherein said second bearing member comprises a footrest carried laterally in a cantilevered fashion by said shelf.

29. A machine according to claim 1, wherein said cradle is supported laterally in a cantilevered fashion by said shelf in such a way as to give rise to a free space between said backrest and said cradle for providing an easy access to said backrest.

* * * * *